United States Patent [19]

Tsuchiyama et al.

[11] 4,449,491

[45] May 22, 1984

[54] LUBRICATING DEVICE FOR INTERNAL COMBUSTION ENGINE

[75] Inventors: Tadashi Tsuchiyama; Yoshiaki Hidaka, both of Saitama, Japan

[73] Assignee: Honda Giken Kogyo Kabushiki Kaisha, Tokyo, Japan

[21] Appl. No.: 342,785

[22] Filed: Jan. 26, 1982

[30] Foreign Application Priority Data

| | | | |
|---|---|---|---|
| Jan. 30, 1981 | [JP] | Japan | 56/12648 |
| Jan. 30, 1981 | [JP] | Japan | 56/12649 |
| Feb. 9, 1981 | [JP] | Japan | 56/17811 |

[51] Int. Cl.[3] ..... F01M 1/06; F01M 9/10

[52] U.S. Cl. ..... 123/90.34; 123/90.33; 123/90.36

[58] Field of Search ..... 123/90.33, 90.34–90.35, 123/90.36–90.39, 90.48, 90.57

[56] References Cited

U.S. PATENT DOCUMENTS

| | | | |
|---|---|---|---|
| 1,784,767 | 12/1930 | Summers | 123/90.57 |
| 3,967,602 | 7/1976 | Brown | 123/90.34 |
| 4,258,673 | 4/1981 | Stoody, Jr. et al. | 123/90.34 |
| 4,276,783 | 7/1981 | Anderson | 123/90.34 |
| 4,327,678 | 5/1982 | Pollet | 123/90.39 |

*Primary Examiner*—Charles J. Myhre
*Assistant Examiner*—E. Rollins Cross
*Attorney, Agent, or Firm*—Lyon & Lyon

[57] ABSTRACT

A lubricating system of an internal combustion engine is equipped with intake and exhaust valves and a valve operating mechanism having rotating portions and reciprocating portions. The rotating portions are communicated with an oil pump via a first oil path and the reciprocating portions are also communicated with the oil pump via a second oil path. The rotating portions have a cam shaft in operative connection with a crank shaft. The reciprocating portions include a rocker follower pivoted to a follower shaft and engaging the cam shaft, a rocker arm pivoted to a rocker shaft and operatively connected to the intake or exhaust valve, and a push rod connecting the rocker follower and rocker arm. A series feed oil path is defined in the follower shaft, rocker follower, push rod, rocker arm and rocker shaft so as to pass through their mutual contact portions, and is communicated with the oil pump via the second oil path. Accordingly, in this construction the mutual contact portions between the rotating portions and the reciprocating portions can effectively be lubricated by one lubricating system.

7 Claims, 9 Drawing Figures

LUBRICATING DEVICE FOR INTERNAL COMBUSTION ENGINE

BACKGROUND OF THE INVENTION

1. Field of the Invention

This invention relates to an internal combustion engine, and more particularly to a lubricating device for a valve operating mechanism. The device feeds a lubricant to rotating parts including a cam shaft and to rocking parts including cam followers, push rods, rocker arms and the like actuated by cams on the cam shaft.

2. Description of the Prior Art

In prior art lubricating systems of the kind described, the cam shaft and the rocker arms operatively connected with each other through push rods for operating the intake and exhaust valves are positioned remotely from each other; the rocker arms are normally fed with lubricant through an oil passage branched from an oil passage for the cam shaft.

With such a lubricating system, an oil pressure drop may take place in the oil passage for the cam shaft because a part of the lubricating oil should be used for lubricating the bearings for the cam shaft and the contacting faces of the cam and the cam follower. Accordingly, a sufficient quantity of lubricating oil cannot be fed to the rocker arms to achieve effective lubrication.

SUMMARY OF THE INVENTION

The present invention provides a lubricating system for internal combustion engines which is capable of obviating the above problems encountered with the prior art lubricating systems.

To accomplish this object, in accordance with one of the principal features of the present invention, an oil path communicating with an oil pump is branched into first and second oil flow paths, the first oil flow path communicating with the rotating parts of a valve operating device, while the second oil flow path communicates with the rocking parts of the valve operating device.

It is another object of the present invention to provide a lubricating system for internal combustion engines which is simple in construction and is capable of effectively lubricating the rocking parts including follower shafts, rocker followers, push rods, rocker arms and rocker shafts by means of the second oil flow path.

To accomplish this object, in accordance with another principal feature of the present invention, the second oil flow path is formed in the rocking parts, and their mutual contact portions are lubricated from this second oil flow path.

It is still another object of the present invention to provide a lubricating system for internal combustion engines which provides the second oil flow path by means of an extremely simple construction, easy to produce.

To accomplish this object, in accordance with still another feature of the present invention, the second oil flow path comprises a cam shaft bore in the engine block, an annular recess formed in the outer open end of the cam shaft bore, and a collar fitted into the cam shaft bore for supporting the cam shaft and closing the opening of the annular recess. The annular recess communicates with the oil pump and the follower shafts so that the lubricant fed from the oil pump is supplied to the rocking parts by way of the annular recess.

According to this construction, the annular recess can be formed easily either by cutting or by casting, and an annular oil path is defined in the annular recess by merely fitting the collar to the shaft bore so that the oil path close to the shaft bore can be formed especially easily. The annular path, or the annular recess, can be cleaned easily when the collar is removed.

If the open end face of the annular recess is closed by the fitting flange of the collar, the fitting flange serves as a lid for the annular recess, thereby simplifying the construction.

Since the annular recess also communicates with an oil path leading to another shaft bore formed in the engine main frame, the lubricant can simultaneously be distributed from the annular recess to a plurality of shaft bores so that the feed oil paths to the plural shaft bores can be constructed easily.

It is still another object of the present invention to provide a lubricating system which is capable of facilitating assembly, maintenance and inspection of the oil pump, and simplifying the feed oil path extending from the oil pump to the oil chamber.

To accomplish this object, in accordance with still another feature of the present invention, the oil pump is disposed in a front cover which encloses the drive and driven pulleys respectively mounted on the crank shaft and cam shaft. Transmission chains are entrained around the pulleys. The oil chamber is formed in a main-bearing cap cover of the crank shaft and is connected to the outlet port of the oil pump; and the first and second oil flow paths communicate with the oil chamber.

In the device embodying the invention, the fitting face of the cover to the engine main frame encompasses the fitting face of the oil pan to the engine main frame. According to this construction, interference can be prevented between the cover and the oil pan; the cover can easily be mounted and dismounted; and the oil pan can be perfectly sealed to the engine main frame.

The above and other objects, features and advantages of the present invention will become apparent from the following detailed description of a preferred embodiment when taken in conjunction with the accompanying drawings.

DESCRIPTION OF THE PREFERRED EMBODIMENTS

Figure 1:
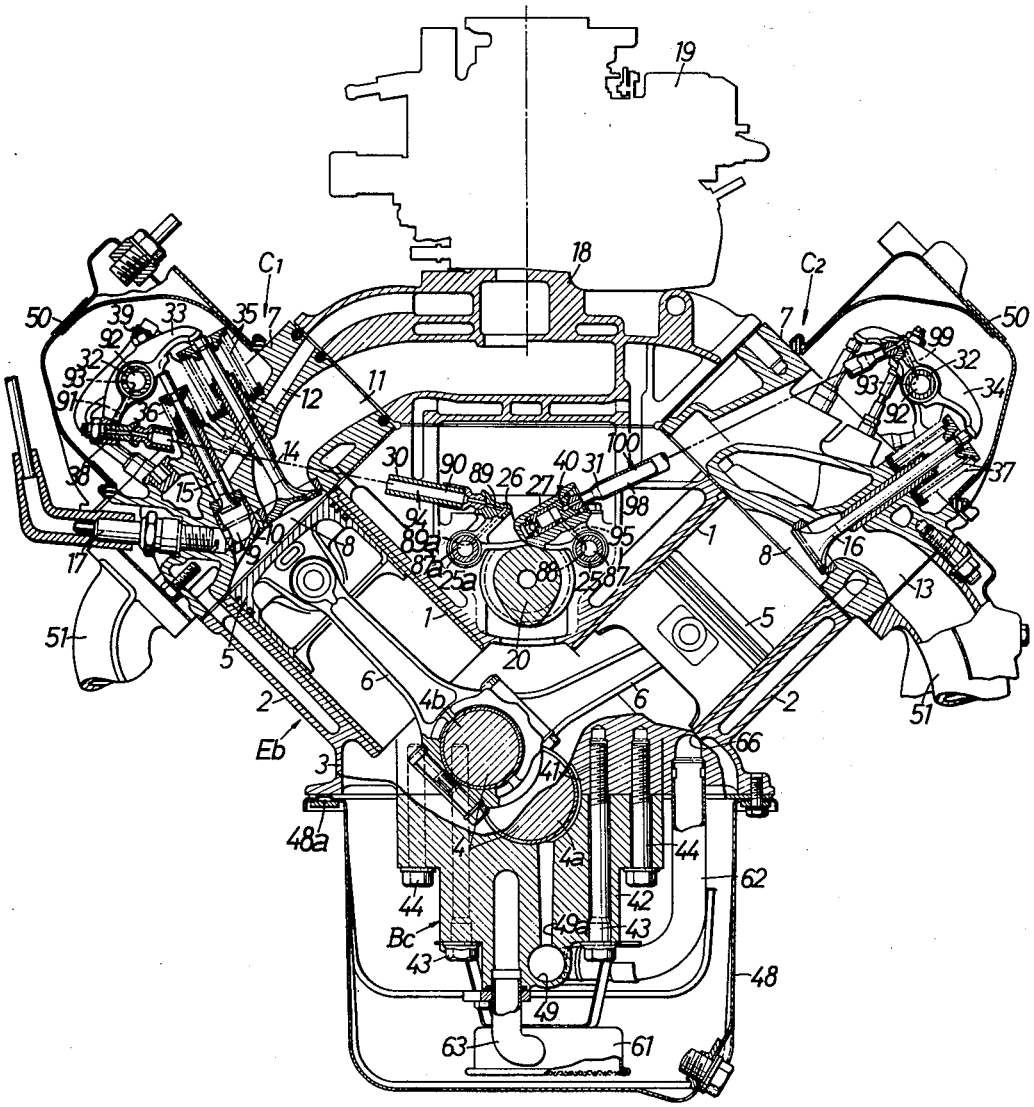
FIG. 1 is a transverse sectional front view of a V-type multiple cylinder internal combustion engine equipped with the lubricating devices in accordance with the present invention.

A V-type multiple cylinder internal combustion engine is composed of right and left cylinder banks $C_1$ and $C_2$ arranged in a V-shape and each having plural cylinders 1 juxtaposed with one another.

A cylinder head 7 is secured to the upper end of a cylinder block 2 of each cylinder bank $C_1$, $C_2$, and a crank case 3, which is common to both cylinder banks $C_1$, $C_2$, is integrally secured to the lower end of each cylinder block 2 and the crank case 3 together form an engine main frame Eb. A semi-annular bearing 41 for supporting the upper half circumferential portion of the journal 4*a* of the crank shaft 4 is formed on the lower face of the crank case 3. A bearing cap 42 for supporting the lower half circumferential portion of the journal 4*a* is coupled to the lower face of the crank case 3. The abutting faces of the crank case 3 and the bearing cap 42 are formed in a horizontal plane passing through the axis of the journal 4*a*. The bearing cap 42 is fixed to the crank case 3 by means of at least a pair of elongated bolts 43 disposed so as to interpose the journal 4*a* between them at least a pair of short bolts 44 disposed outside both elongated bolts 43.

A piston 5 sliding in each cylinder 1 is connected to a crank pin 4*b* of the crank shaft 4 via a connecting rod 6.

In each cylinder head 7 of the cylinder banks $C_1$, $C_2$ are formed a main combustion chamber 8 defined by the piston 5, an auxiliary combustion chamber 9 communicating with the main combustion chamber 8 via a torch nozzle 10, a main intake port 11 and exhaust port 13 opening to the main combustion chamber 8, and an auxiliary intake port 12 opening to the auxiliary combustion chamber 9. The main intake port 11, auxiliary intake port 12 and exhaust port 13 are opened and closed by a main intake valve 14, an auxiliary intake valve 15 and an exhaust valve 16, respectively. Valve springs 35, 36 and 37 act upon these valves 14, 15 and 16 so as to urge them in their closing direction, respectively.

A spark plug 17 is threaded to each cylinder head 7 in such a fashion that its electrode faces the auxiliary combustion chamber 9.

An intake mainfold 18 is mounted between the cylinder heads 7, 7 of both cylinder banks $C_1$ and $C_2$, and a carburetor 19 is fitted onto the upper face. The carburetor 19 supplies a lean mixture to all the main intake ports 11 and a rich mixture to all the auxiliary intake ports 12, respectively, by way of the intake manifold 18.

A cam shaft 20 is mounted on the cylinder blocks 2 at the center between the cylinder banks $C_1$ and $C_2$ as close as possible to the crank shaft 4, and one end of the cam shaft 20 protrudes from the front side face of the cylinder blocks 2. Timing gears 21 and 22 are fixed to the end of the crank shaft 4 protruding from the crank case 3 and to the protruding end of the cam shaft 20, respectively, and a timing chain 23 is trained between the timing gears 21, 22. These timing gears and timing chain form a timing transmission device 24. The cam shaft 20 is driven at a reduction ratio of 2:1 by the crank shaft 4 via the timing transmission device 24. The above arrangement of the cam shaft 20, timing gears 21, 22 and the timing chain 23 is well known in the art and does not form a part of the present invention.

A pair of right and left follower shafts 25 are disposed between the cam shaft 20 and the cylinder banks $C_1$ and $C_2$ in such a fashion as to interpose the cam shaft 20 between them. An intake rocker follower 26 and an exhaust rocker follower 27 are pivoted to the respective follower shafts 25 and extend therefrom in directions away from the adjacent cylinders 1. The intake rocker follower 26 has a first arm in camming engagement with an intake cam 20*a* mounted on the cam shaft 20, and a second arm connected through a ball joint with the lower end of the intake push rod 30. Similarly, the exhaust rocker follower 27 has a first arm in camming engagement with an exhaust cam 20*b* mounted on the cam shaft 20, and a second arm connected through a ball joint with the lower end of the exhaust push rod 31.

An intake rocker arm 33 and an exhaust rocker arm 34 are pivotally supported by the rocker shaft 32 which is in turn supported by each cylinder head 7. The upper ends of the main intake valve 14 and auxiliary intake valve 15 come into contact with the tip and intermediate portions of an inner arm of the intake rocker arm 33 that extends towards the intake manifold 18. The upper end of the intake push rod 30 is connected to the tip of an outer arm of the rocker arm 34 in a spherical surface arrangement. The upper end of the exhaust valve 16 comes into contact with the tip of an outer arm of the exhaust rocker arm 34 and the upper end of the exhaust push rod 31 is connected to the tip of an inner arm of the rocker arm 34 in the spherical surface arrangement. The intake rocker arm 33 is equipped with valve clearance adjusting bolts 38 and 39 at its spherical surface connecting portion with respect to the push rod 30, and at its abutting portion with respect to the auxiliary intake valve 15, respectively. Though not equipped with such adjusting bolts, the exhaust rocker follower 27 is equipped with a built-in hydraulic tappet device 40.

This hydraulic tappet device 40 is explained in detail, as follows. As can be best seen from FIG. 4, the exhaust rocker follower 27 is equipped, at the tip thereof, with an oil pressure cylinder 71 having its axis in the rocking direction. Pistons 72 and 73, that are divided in the vertical direction, slide in the cylinder 71, and the inner end portion of the push rod 31 is connected to the upper piston 72 through a ball joint.

A first oil chamber 74 is defined between both pistons 72 and 73. Between the lower piston 73 and the bottom of the oil pressure cylinder 71 is defined a second oil chamber 75 that is communicated with the first oil chamber 74 via a valve hole 76. A spring 77 and a check valve 78 are placed inside the second oil chamber 75. The spring 77 upwardly urges the lower piston 73 and the check valve 78 is forced to close the valve hole 76 by the force of the spring 77. The lubricant is fed into the first oil chamber 74 via oil passages 88 and 95 described below.

When the exhaust rocker follower 27 is in contact with the cam 20*b* on the base circle, the pistons 72 and 73 are pushed upward by the spring 77, reducing to zero the clearance at the head of the exhaust valve 16. The check valve 78 is opened and the oil in the first oil chamber 74 is fully charged into the second oil chamber 75. When the cam 20*b* starts lifting, the check valve 78 is closed to increase the oil pressure in the second oil chamber 75 so that the pistons 72 and 73 rock together with the rocker follower 27 and serve to push up the push rod 31.

Figure 7:
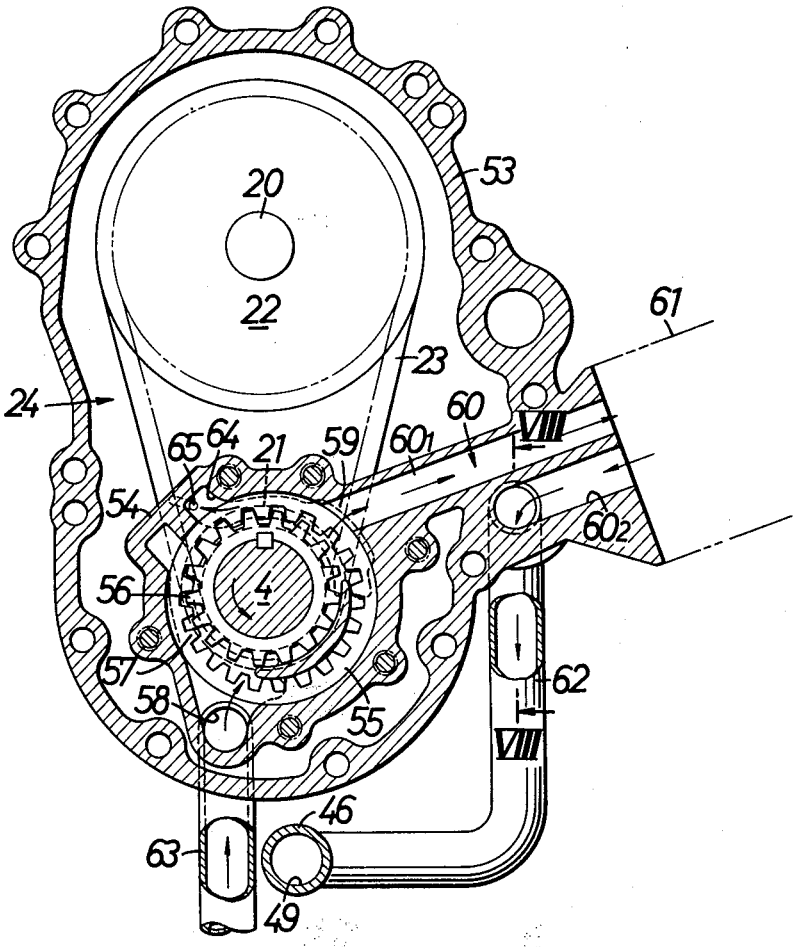
FIG. 7 is a sectional view taken along line VII-VII of FIG. 2.
Figure 8:
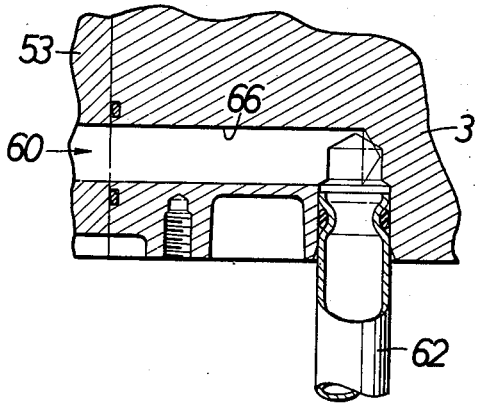
FIG. 8 is a sectional view taken along line VIII-VIII of FIG. 7.

The timing device 24 is placed in a recess 52 formed continuously on the respective front faces of the cylinder block 2 and crank case 3, and a front cover 53 for covering the timing device 24 is detachably fitted to the opening of the recess 52. Accordingly, the fitting face 53*a* of the cover 53 is positioned axially forward of the fitting faces of the oil plan 48 and the crank case 3. As shown in detail in FIGS. 7 and 8, a casing 54 for an oil pump is disposed on the front cover 53 and an internal gear type oil pump 55 is accommodated therein. A driving gear 56 of the oil pump 55 is key-coupled to the protruding end of the crank shaft 4 and a driven gear 57 is rotatably fitted into the casing 54. A suction port 58 and an outlet port 59 are formed in the casing 54 and an outlet oil passage 60 communicating with the outlet port 59 is formed integrally with the cover 53. The outlet oil passage 60 comprises a pair of oil passages $60_1$ and $60_2$ that are parallel to each other in the embodiment shown, and an oil filter 61 fitted to the external side face of the front cover 53 is interposed between these oil passages $60_1$ and $60_2$. The outlet oil passage 60 is in communication with an oil passage 66 in the crank case 3 and with a main oil chamber 49 via a connecting tube 62 that is disposed inside the oil pan 48. Also, the suction port 58 in the casing 54 is in communication with an oil reservoir at the bottom of the oil pan 48 via a suction tube 63 that is disposed inside the oil pan 48.

A groove 64 communicating with the outlet port 59 is defined on the inner circumferential face of the casing 54 and a jet hole 65 is obliquely formed at the tip of the bottom of the guide groove 64 so as to jet the lubricant toward the timing chain 23 of the timing transmission device 24.

Figure 9:
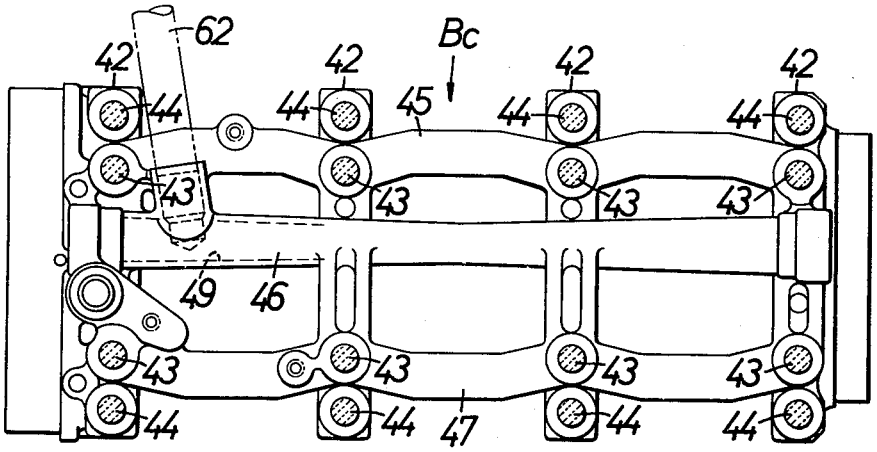
FIG. 9 is a bottom view of a bearing cap assembly.

The oil pump 55 is operated by rotation of the crank shaft 4 to suck the lubricant stored in the oil pan 48 through the suction tube 63 and discharge it to the main oil chamber 49 in a bearing cap assembly BC by way of the oil passage $60_1$, the oil filter 61, oil passage $60_2$, oil passage 66 in the crank case 3 and the connecting tube 62. As shown in FIG. 9, the bearing cap assembly BC comprises three connecting bars 45, 46, 47 and four bearing caps 42 aligned on a line and connected to the bars. The bearing cap assembly BC is disposed inside the oil pan 48 and fitted to the lower face of the crank case 3. In the bearing caps 42 are formed a plurality of branch oil passages 49*a* which extend from this main oil chamber 49 to the lubricated portions of the journals 4*a* of the crank shaft 4. Accordingly, the lubricant fed from the oil pump 55 into the main oil chamber 49 is distributed to the plural branch oil passages 49*a* to lubricate the journals 4*a* of the crank shaft 4. The lubricant then passes through an oil passage 111 formed in the crank shaft 4 and reaches and lubricates the bearing faces of the crank pins 4*b*. The oil leaking from the bearing faces between the large end portion of the crank pins 4*b* and the connecting rods 6 scatters therearound and lubricates the inner walls of the cylinder 1 and the piston 5.

Figure 2:
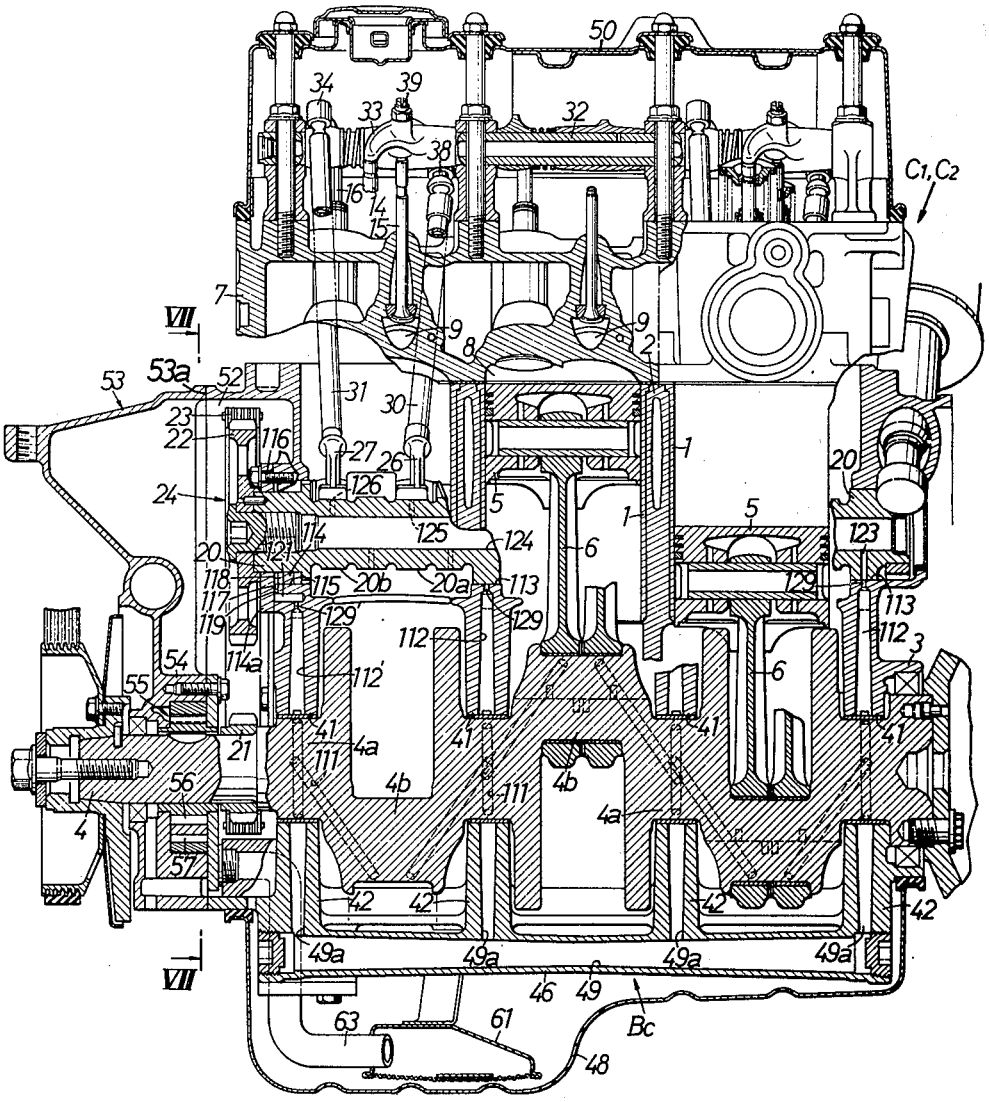
FIG. 2 is its longitudinal sectional side view of one bank of cylinders.
Figure 3:
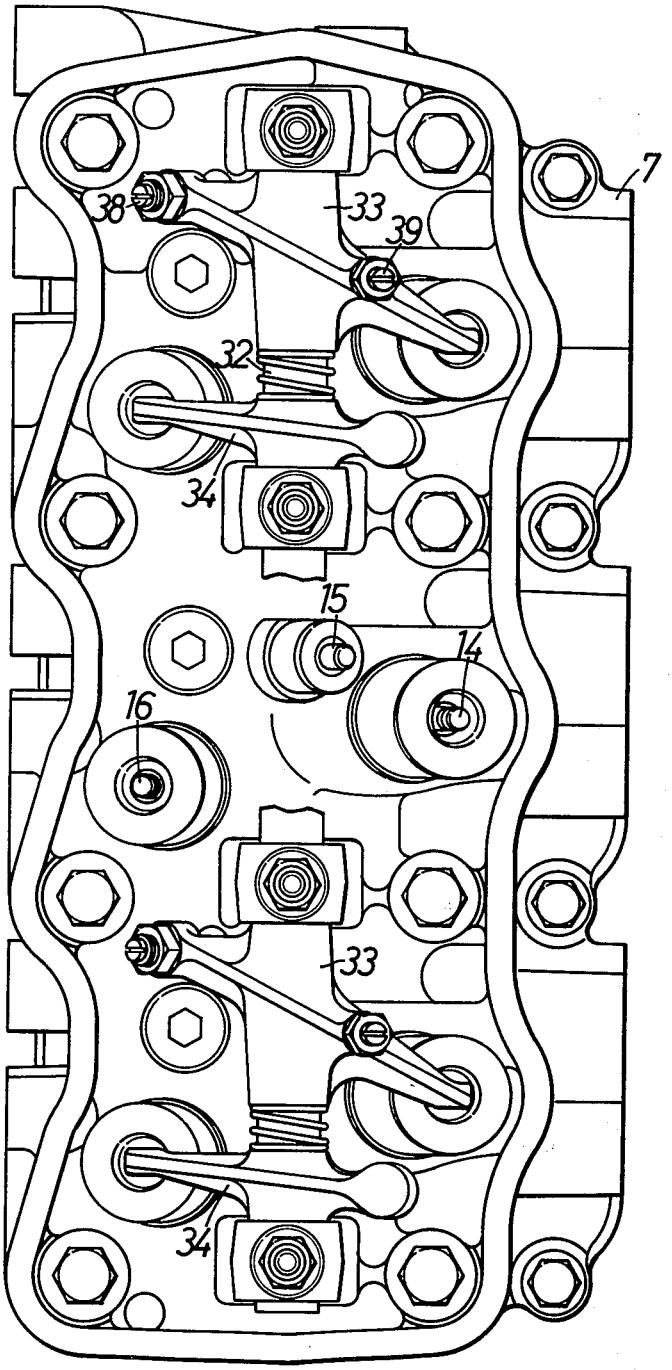
FIG. 3 is an enlarged plan view of one of cylinder banks, the head cover being removed therefrom.
Figure 6:
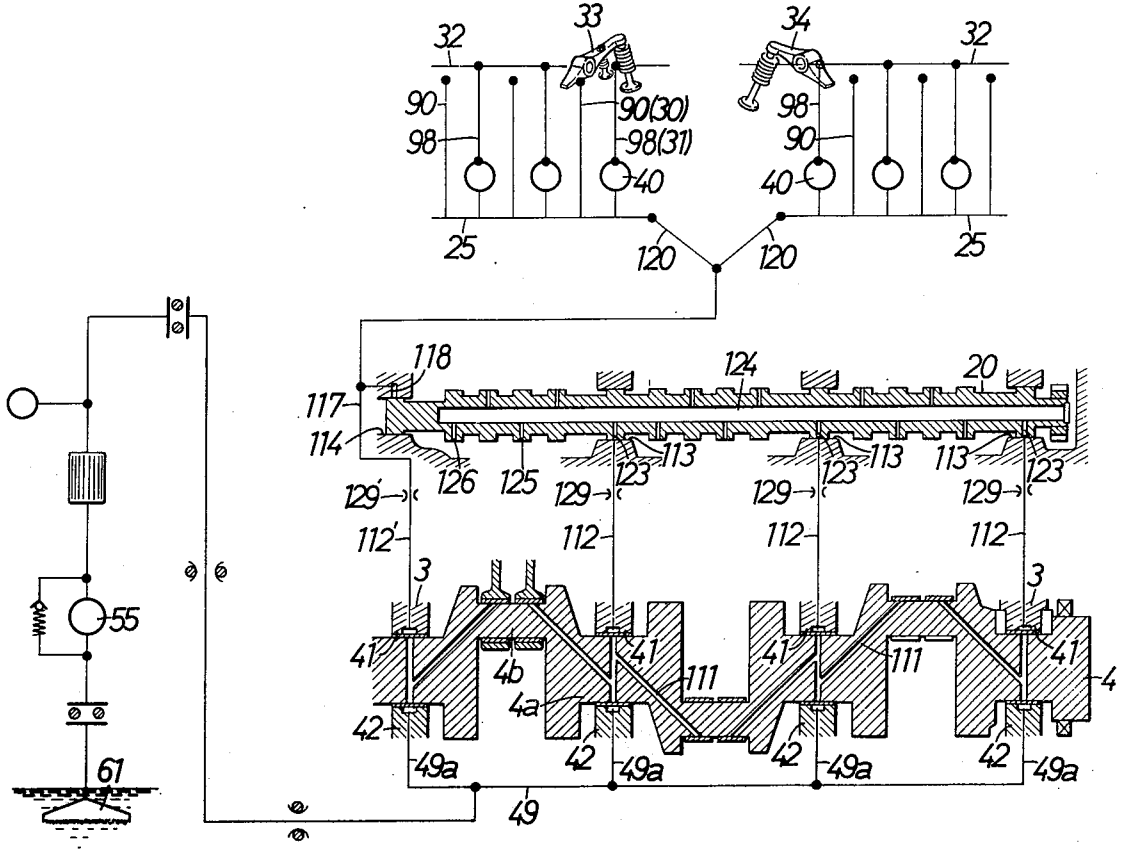
FIG. 6 is a schematic diagram showing the outline of the lubricating system of the engine.

A part of the lubricant fed to the plural branch oil passages 49*a* is fed to the same number of oil passages 112, 112' as the number of the branch passages 49*a*, the oil passages 112, 112' being defined in the wall of the cylinder blocks 2. In FIGS. 2 and 6, the oil passages 112 other than the extreme left oil passage 112' are in direct communication with the inner faces of the bearings 113 for the journal portions of the cam shaft 20 and hence, the lubricant fed into the oil passages 112 immediately lubricates the cam shaft journal portions.

Also, the oil passage 112' on the extreme left in FIGS. 2 and 6 communicates with the cam shaft journal portion on the extreme left in FIG. 2, and with respective lubricated portions of the pair of follower shafts 25 in the following manner.

The bearing of the cam shaft 20 for the journal on the extreme left in FIG. 2 comprises a collar 114 equipped with a fitting flange 114*a* at its outer end portion. The collar 114 is fitted into a cam shaft bore 115 opening to the outer wall of each cylinder block 2, and the fitting flange 114*a* is fixed to the cylinder block 2 by bolts 116. An annular recess 117 is defined around an outer open end of the cam shaft bore 115. The inner face and outer open end of the annular recess 117 are closed by a cylindrical portion of the collar 114 and by the flange 114*a*, thereby forming an annular oil passage. An oil passage 118 is formed in the collar 114 so as to communicate with the annular recess 117 and to extend in the radial direction. The oil passage 118 opens to the bearing face of the cam shaft 20 with respect to the journal on the extreme left in FIG. 2.

Figure 5:
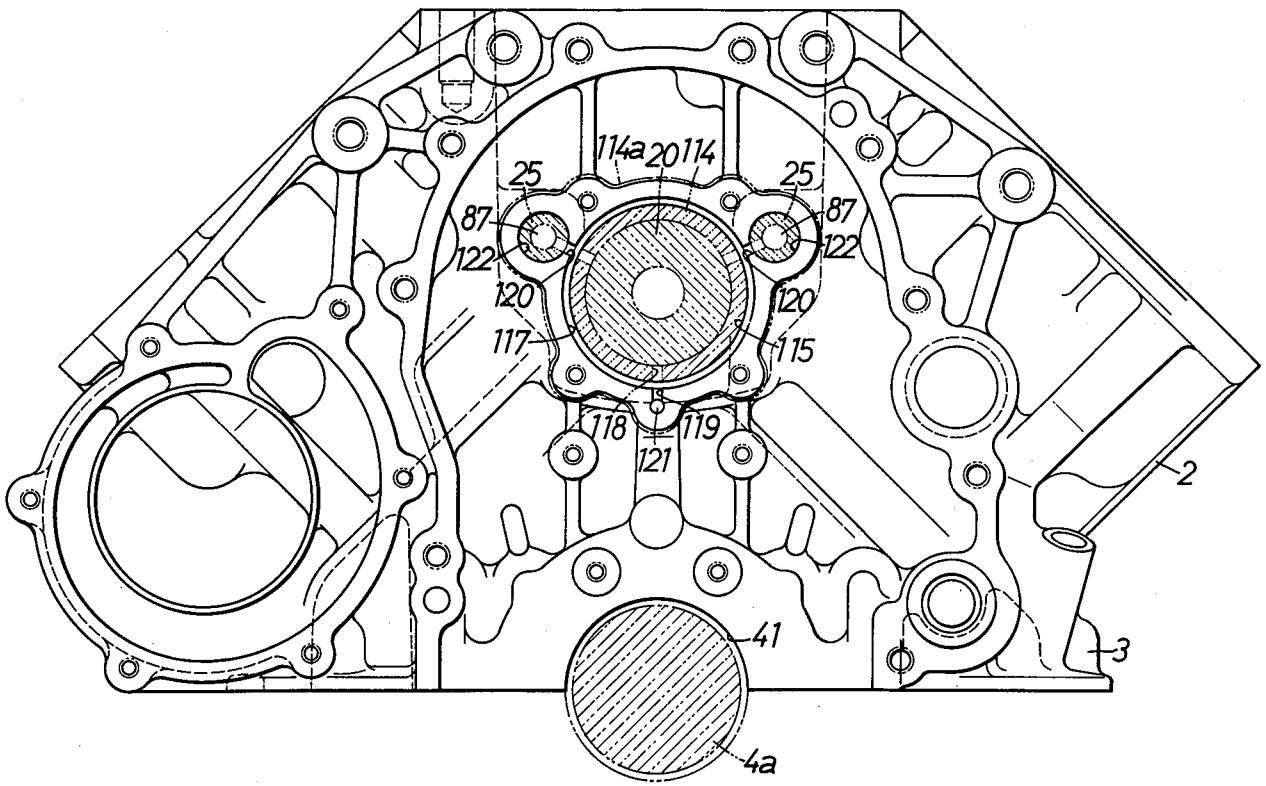
FIG. 5 is a front view of the cylinder block and crank case assembly.

Three communication grooves 119, 120 extend in the radial direction from the annular recess 117, as shown in FIG. 5. The groove 119 communicates with an opening 121 of an oil passage 112' to the outer side face of the cylinder block 2, while the other two grooves (120) communicate with follower shaft bores 122 of the pair of follower shafts 25 disposed in the cylinder block 2, respectively. The open ends of these grooves 119 and 120 are closed by a flange 114*a* to form an oil passage.

As depicted in FIG. 1, the follower shaft 25 is provided with an axial oil passage 87 and with plural radial oil passages 88 extending radially from the axial oil passage 87 and opening to the outer circumferential face. The axial oil passage 87 communicates with the annular recess 117 via communication grooves 120. The intake rocker follower 26 is equipped with oil passages 89 and 89*a* that establish communication with its bearing face and the connection face on the intake push rod 30. The intake push rod 30 is equipped with an axial oil passage 90 which communicates opposite connection faces of the push rod 30 with respect to the rocker follower 26 and the rocker arm 33. The major portions of the axial oil passage 90 are formed in a hollow rod-like portion of the push rod 30 made of a metallic pipe. The intake rocker arm 33 is equipped with an oil passage 91 communicating its bearing face with the connection face on the push rod 30. The rocker shaft 32 is equipped with an axial oil passage 92 and with plural radial oil passages 93 extending radially from the axial oil passage 92 and opening to the outer circumferential face. A series feed oil path 94 passing through the mutual contact portions of the follower shaft 25*a*, rocker follower 26, push rod 30, rocker arm 33 and rocker shaft 32 is defined by these oil passages 87*a* through 93.

Figure 4:
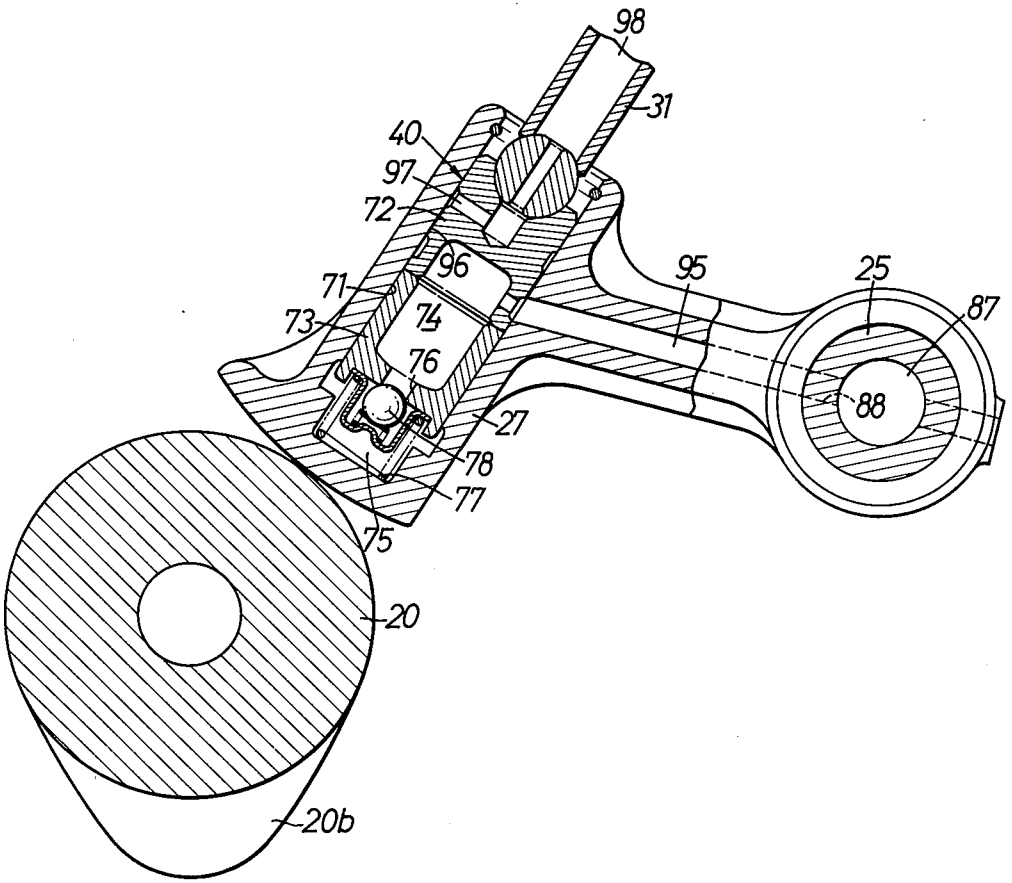
FIG. 4 is an enlarged longitudinal sectional view of an exhaust rocker follower having an oil pressure tappet mechanism.

Similarly, the exhaust rocker follower 27 is equipped with an oil passage 95 communicating the oil passage 88 in the follower shaft 25 with the first oil chamber 74 of the hydraulic tappet device 40, as shown in FIG. 4. The upper piston 72 is equipped with a radial oil hole 97 establishing communication between a leak oil gap 96 between it and the oil pressure cylinder 71, and the upper connection face of the push rod 31. The exhaust push rod 31 and rocker arm 34 are equipped with oil passages 98 and 99, respectively, in the same way as in the intake push rod 30. The oil passage 99 communicates with the oil passage 93 in the rocker shaft 32. These oil passages 87, 88, 95, 98, 99, the first oil chamber 74 and the leak oil gap 96 form a series feed oil path 100 passing the mutual contact portions of the follower shaft 25, rocker follower 27, push rod 31 and rocker shaft 32.

In the above described construction, the branch oil flow passages 49*a*, oil passages 112, radial oil passages 123, axial oil passage 124 and radial oil passages 125, 126 jointly constitute a first oil flow path for feeding lubricating oil to the bearings 41 for the crank shaft 4, the bearings 113 for the cam shaft 20, and the contacting portions between the intake and exhaust cams 20*a*, 20*b* and the intake and exhaust rocker followers 26, 27. Thus, lubricating oil is fed from the main oil chamber 49 to the inner faces of the bearings 113 for the cam shaft 20 by way of the branch oil passages 49*a* and the oil passages 112. After lubricating respective journal portions of the cam shaft 20, the lubricating oil flows into the axial passage 124 in the cam shaft 20 through the radial oil passages 123 opening to the outer circumferential faces of the journal portions, flows out from the radial oil passages 125, 126 opening to the outer circumferential faces of the cams 20*a*, 20*b* and lubricates the camming faces of the cams 20*a*, 20*b* in sliding contact with the rocker followers 26, 27, respectively, that is, the rotating parts of the valve operating device.

Furthermore, the oil passage 112', annular recess 117, oil passages 120, and the series feed oil paths 94, 100 jointly constitute a second oil flow path for feeding lubricating oil to the rocker arm shafts 32. Lubricating oil is fed from the main oil chamber 49 to the annular recess 117 by way of one of the branch oil passages 49*a*, the oil passage 112' and the communication groove 119. A part of the lubricating oil is fed from the annular recess 117 to the circumferential face of the collar 114 via the oil passage 118 to lubricate the journal portion on the extreme left of the cam shaft 20. The rest of the lubricating oil in the annular recess 117 is fed to the shaft bores 122 through the radial passages 120 to lubricate the follower shafts 25, and thence passes through the series feed oil paths 94, 100 into the axial oil passages 92 in the rocker arm shafts 32, respectively, thereby lubricating the mutual contact portions of the adjacent members. In this manner, the rocking parts actuated by the cams 20*a*, 20*b* on the cam shaft 20 are lubricated.

In the drawings, reference numerals 50 represents a head cover; 51 an exhaust manifold; 129, 129'oil flow rate adjusting orifices in the oil passages 112, 112'.

In the operation of the engine, the cam shaft 20 is rotated by the crank shaft 4 via the timing transmission device 24 and its intake and exhaust cams 20*a*, 20*b* start lifting, whereupon the intake and exhaust rocker followers 26, 27 are caused to upwardly rock and push up the intake and exhaust push rods 30, 31. As the intake push rod 30 is thus pushed up, the intake rocker arm 33 is caused to rock and opens the main and auxiliary valves 14, 15 against the force of the valve springs 35, 36. Similarly, as the exhaust push rod 31 is pushed up, the exhaust rocker arm 34 is caused to rock and opens the exhaust valve 16 against the force of the valve spring 37. When the cams 20*a*, 20*b* finish lifting, each valve 14, 15, 16 is closed by the resilient force of the respective valve springs 35, 36, 37.

When the main intake valves 14 and auxiliary valves 15 are opened, the pistons 5 are in the intake stroke in the corresponding cylinders 1. Accordingly, a lean mixture is fed into the main combustion chamber 8 through the main intake port 11, while a rich mixture is fed into the auxiliary combustion chamber 9 through the auxiliary intake port 12. In the subsequent compression stroke, the rich mixture within the auxiliary combustion chamber 9 is ignited by the spark plug 17 to form torch flames which jet into the main combustion chamber 8 through the torch nozzle 10 and ignite and burn the lean mixture within the main combustion chamber 8. As a result, the lean mixture having a low fuel-air ratio can be burned. The piston 5 shifts to the expansion stroke and in the subsequent exhaust stroke, the exhaust valve 16 is opened in the aforementioned manner, discharging the combustion gas into the exhaust port 13.

When the oil pump 55 is actuated by the crank shaft 4, the lubricant inside the oil pan 48 is fed into the main oil chamber 49 via the suction pipe 63, the intake port 58, the outlet port 59, one ($60_1$) of the outlet oil passages 60, the oil filter 61, the other ($60_2$) of the outlet oil passages 60, the oil passage 66 of the crank case 3 and the connection pipe 62. The lubricant lubricates all the journals 4*a* at the same time via the branch oil passage 49*a*, for example. The lubricant at the outlet port 59 of the oil pump 55 is led to the jet hole 65 via the guide groove 64 while branching from the oil filter 61 and is jetted towards the timing chain 23 of the timing transmission device 24, thereby lubricating the timing chain with a high level of efficiency. In the fore-going embodiment, the oil pump is actuated by the crank shaft, but it may be actuated by the cam shaft instead.

Although the invention has been shown in a preferred form, it will be obvious to those skilled in the art that it is not so limited, but is susceptible of various other changes and modifications, without departing from the scope and spirit thereof.

I claim:

1. In a lubricating system for an internal combustion engine having intake and exhaust valves and a valve operating device for the intake and exhaust valves mounted on the engine body, the improvement comprising, in combination: a cam shaft turnably mounted in bearing means supported on the engine body, the cam shaft having an oil passage formed therein in communication with said bearing means, a cam on said cam shaft, a rocker arm shaft mounted on the engine body and having an oil passage therein, a rocker arm turnably mounted on the rocker arm shaft and having contacting means engaging said cam, an oil pump adapted to be driven by said engine, an oil chamber formed in the engine body and communicating with said oil pump, a first oil path connecting said oil chamber to said oil passage in the cam shaft, and a second oil path connecting said oil chamber to said oil passage in the rocker arm shaft, whereby lubricating oil supplied from said oil pump is fed independently to the cam shaft and to the rocker arm shaft by way of said first and second oil paths, respectively.

2. In the lubricating system of claim 1 for an engine having a crankshaft wherein a timing transmission device operatively connects the crankshaft to said cam shaft, a cover detachably secured to the outside of the engine body and covering said timing transmission device, and said oil pump disposed in said cover and having a discharge port connected to said oil chamber.

3. In the lubricating system of claim 2 wherein an oil reservoir is provided, said oil chamber formed in said reservoir, said cover and said oil reservoir having fitting faces with respect to said engine body, and said fitting face of said cover being disposed axially forward of said fitting face of said oil reservoir away from the engine body.

4. In a lubricating system for an internal combustion engine having intake and exhaust valves and a valve operating device mounted on the engine body, the improvement comprising, in combination: a cam shaft turnably mounted on the engine body through bearings and having therein an oil passage in communication with said bearings, a cam on said cam shaft, a cam follower shaft mounted on the engine body and having an oil passage formed therein, a cam follower turnably mounted on said cam follower shaft and having a contact face engaging said cam and having an oil passage communicating with said oil passage in said cam follower shaft, a rocker arm shaft mounted on the engine body and having an oil passage formed therein, a rocker arm turnably mounted on said rocker arm shaft and having two extended ends and an oil passage communicating with said oil passage in said rocker arm shaft, one of said extended ends engaging one of said valves, and a push rod connecting said cam follower with said rocker arm and having therein an oil passage communicating with said oil passages in said cam follower and said rocker arm, an oil pump adapted to be driven by the- engine, an oil chamber formed in the engine body and communicating with said oil pump, a crank shaft turnably mounted on the engine body through a main bearing, said main bearing having an oil passage communicating to said oil chamber, a first oil path connecting said oil passage in said main bearing to said oil passage in said cam shaft, and a second oil path connecting said oil passage in said main bearing to said oil passage in said cam follower shaft, whereby lubricating oil supplied from said oil pump is fed independently to said cam shaft and said rocker arm shaft by way of said first and second oil paths, respectively.

5. In a lubricating system for an internal combustion engine having intake and exhaust valves, and having a valve operating device for the intake and exhaust values provided with rotating cam means and rocking arm means for operating said valves, the improvement comprising: an oil pump, a first oil path communicating said rotating cam means with said oil pump, a second oil path communicating said rocking arm means with said oil pump, a shaft supporting one of said rotating cam and rocking arm means, a shaft bore in a wall of the engine, an annular recess formed in an outer open end of said shaft bore and communicating with said second oil path, and a collar fitted into said shaft bore for closing the opening of said annular recess.

6. The lubricating system for an internal combustion engine as defined in claim 5, wherein said collar includes a fitting flange secured to said engine wall and closing said opening of said annular recess.

7. The lubricating system for an internal combustion engine as defined in claim 5, further comprising: a second shaft supporting the other of said rotating cam and rocking arm means, a second shaft bore in the wall of the engine, and an oil passage communicating said second shaft bore with said annular recess.

* * * * *